US008161646B2

(12) United States Patent
Lin

(10) Patent No.: US 8,161,646 B2
(45) Date of Patent: Apr. 24, 2012

(54) METHOD OF MANUFACTURING HEAT RADIATING FIN

(75) Inventor: Kuo-Sheng Lin, Sinjhuang (TW)

(73) Assignee: Asia Vital Components Co., Ltd., Taipei County (TW)

( * ) Notice: Subject to any disclaimer, the term of this patent is extended or adjusted under 35 U.S.C. 154(b) by 1026 days.

(21) Appl. No.: 12/082,705

(22) Filed: Apr. 11, 2008

(65) Prior Publication Data

US 2009/0139088 A1 Jun. 4, 2009

(30) Foreign Application Priority Data

Dec. 4, 2007 (TW) ..... 96146044 A

(51) Int. Cl.
*B23P 15/16* (2006.01)

(52) U.S. Cl. ..... 29/890.04; 29/890; 29/890.035; 29/890.039; 29/890.045; 29/890.046

(58) Field of Classification Search . 29/890.03–890.054
See application file for complete search history.

(56) References Cited

U.S. PATENT DOCUMENTS 2,274,550 A * 2/1942 Karmazin ..... 29/890.039
6,725,909 B1 4/2004 Luo ..... 165/104.21

* cited by examiner

*Primary Examiner* — Richard Chang

(57) ABSTRACT

In a method of manufacturing heat radiating fin, the technique of plastic working, such as stamping, is employed to apply an external force against a sheet metal material serving as a raw material for forming the heat radiating fin, so that the sheet metal material generates plastic deformation to form a plurality of recessed portions on a front side thereof. Meanwhile, a plurality of protruded portions is correspondingly formed on a rear side of the sheet metal material behind the recessed portions. Any two heat radiating fins so manufactured may be easily stacked and connected together with the protruded portions on a rear or higher heat radiating fin partially extended into the recessed portions on a front or lower heat radiating fin.

10 Claims, 19 Drawing Sheets

(D)

(E)

METHOD OF MANUFACTURING HEAT RADIATING FIN

FIELD OF THE INVENTION

The present invention relates to a method of manufacturing heat radiating fin, and more particularly to a method for manufacturing heat radiating fins that can be quickly stacked to form a heat sink and can be repeatedly dismounted from and remounted to the heat sink without becoming deformed.

BACKGROUND OF THE INVENTION

FIG. 2 is a flowchart showing the steps included in a conventional method of manufacturing heat radiating fins.

In a first step (11), a metal material is prepared. The metal material may be a sheet metal material 2 as shown in FIG. 1A to be used as a raw material for manufacturing a heat radiating fin. The sheet metal material 2 may be aluminum or copper or other heat conducting sheet materials.

In a second step (12), the sheet metal material 2 is positioned on a punching mold for punching.

In a third step (13), the sheet metal material 2 is primarily shaped by punching to form two opposite edges 21 with two hooking ends 211 each, as shown in FIG. 1B.

In a fourth step (14), the two opposite edges 21 are bent, so that an angle about 90 degrees is contained between the bent edges 21 and a main body of the sheet metal material 2 to complete a heat radiating fin, as shown in FIG. 1C.

In a fifth step (15), use a tool to stack a plurality of the heat radiating fins obtained in the fourth step (14), so that the hooking ends 211 on the two bent edges 21 of an upper heat radiating fin are rested on the hooking ends 211 on the two bent edges 21 of a lower heat radiating fin, as shown in FIG. 1D.

In a sixth step (16), the hooking ends 211 on each heat radiating fin are separately bent inward to hook on an adjacent heat radiating fin, so that the two heat radiating fins are connected to each other, as shown in FIG. 1E.

In the conventional method, the heat radiating fins are manufactured by way of punching or stamping, so that the sheet metal material 2 is punched or compressed to obtain desired shape and mechanical properties. In either way, the sheet metal material 2 must be cut and bent at two opposite edges, so as to form the hooking ends and hook the bent hooking ends on one heat radiating fin to another heat radiating fin, and thereby connect two stacked heat radiating fins.

Most currently available heat sinks are formed by stacking aluminum or copper heat radiating fins, and the stacked heat radiating fins are hooked and connected together by the hooking ends formed on two bent edges of the sheet metal material 2 using punching or stamping molds. The size and shape of the hooking ends, as well as the manner of hooking and connecting two adjacent heat radiating fins via the hooking ends must vary with different types of products. Errors in the size of the bent edges and hooking ends easily occur in the manufacturing process. The hooking ends are separately formed at two bent edges of the sheet metal material and therefore have relatively low structural strength and tend to deform when they are adjusted, pulled, or pushed under an external force. Once the hooking ends are deformed, it is difficult to repair or remake them. Even if the deformed hooking ends are adjusted or repaired, they might not be exactly restored to the original shape or size.

The heat radiating fins manufactured in the conventional method have relatively complicated structure, and therefore require experienced and skilled persons and longer time to design and perform the fabrication of the heat radiating fins. Even so, the bad yield is still high.

The molds used in the conventional method to manufacture the heat radiating fins usually include small parts which are subject to damage easily, and must also be designed and produced at high precision. Besides, slide blocks are often needed in the molds for the conventional method of manufacturing heat radiating fins to further complicate the mold structure and increase the time for developing and repairing the molds, resulting in additional costs. In summary, the conventional method of manufacturing heat radiating fins has the following disadvantages: (1) the hooking ends on the heat radiating fins are easily deformable; (2) the molds therefor are complicate and expensive; (3) the overall manufacturing cost is high; (4) the heat radiating fins have complicated structure and require more time and labor to manufacture; and (5) the molds includes small parts that damage easily.

It is therefore tried by the inventor to develop an improved method of manufacturing heat radiating fin to overcome the drawbacks in the conventional method.

SUMMARY OF THE INVENTION

A primary object of the present invention is to provide a method of manufacturing heat radiating fin, in which the technique of plastic working, such as stamping, is employed to form structurally strong connecting means on the heat radiating fins, so that the heat radiating fins may be quickly and stably stacked to form a heat sink.

Another object of the present invention is to provide a method of manufacturing heat radiating fin, with which a heat radiating fin may be manufactured with largely reduced raw material and scraps.

A further object of the present invention is to provide a method of manufacturing heat radiating fin, with which a plurality of heat radiating fins may be continuously manufactured using relatively simple molds, enabling simplified manufacturing procedures and high production efficiency.

To achieve the above and other objects, the method of manufacturing heat radiating fin according to a preferred embodiment of the present invention employs the technique of plastic working, such as stamping, to apply an external force on a heat-conducting sheet material, such as aluminum or copper material, so that the sheet material generates plastic deformation to form a plurality of recessed portions on one side thereof while a plurality of protruded portions are correspondingly formed on the other side of the sheet material behind the recessed portions.

A plurality of heat radiating fins manufactured in the method of the present invention may be stacked to form a heat sink. At this point, the protruded portions on a second heat radiating fin is partially extended into the recessed portions on a first heat radiating fin located before or below the second heat radiating fin, so that the first and the second heat radiating fin are associated with each other via the engaged protruded portions and recessed portions.

In the event there is size error in the height of the manufactured heat radiating fins, an adjusting tool may be used to adjust an overall height of the heat sink formed from the stacked heat radiating fins.

Since the protruded portions are integrally formed on the heat radiating fins without any seam or separately formed bent edge to thereby have enhanced structural strength. As a result, the protruded portions are not easily deformed under an external force when a heat radiating fin is dismounted from the heat sink, and may still fitly and tightly contact with the recessed portions on another heat radiating fin without the risk of separating therefrom when the dismounted heat radiating fin is remounted to the heat sink. Therefore, the method of the present invention effectively reduces the bad yield in manufacturing heat radiating fins. Another advantage of the present invention is that the recessed and the protruded portions on the heat radiating fins have simple structure, so that the molding tools for forming them may have simple structure to reduce mold cost. With the relatively simple structure without too many small parts, the molds used in the method of the present invention may be produced with low bad yield, which in turn enables upgraded productivity of the heat radiating fins.

In summary, the present invention provides the following advantages:

a. The protruded and recessed portions for connecting the heat radiating fins together are integrally formed on the heat radiating fins to thereby have relatively high structural strength.
b. The molds used in the method of the present invention have relatively simple structure without too many small parts, and are therefore not easily damaged.
c. The molds for the present invention may be made at low cost.
d. The method of the present invention involves only simple manufacturing procedures.
e. The method of the present invention enables manufacturing of heat radiating fins at high efficiency.
f. The method of the present invention enables manufacturing of heat radiating fins at reduced cost.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
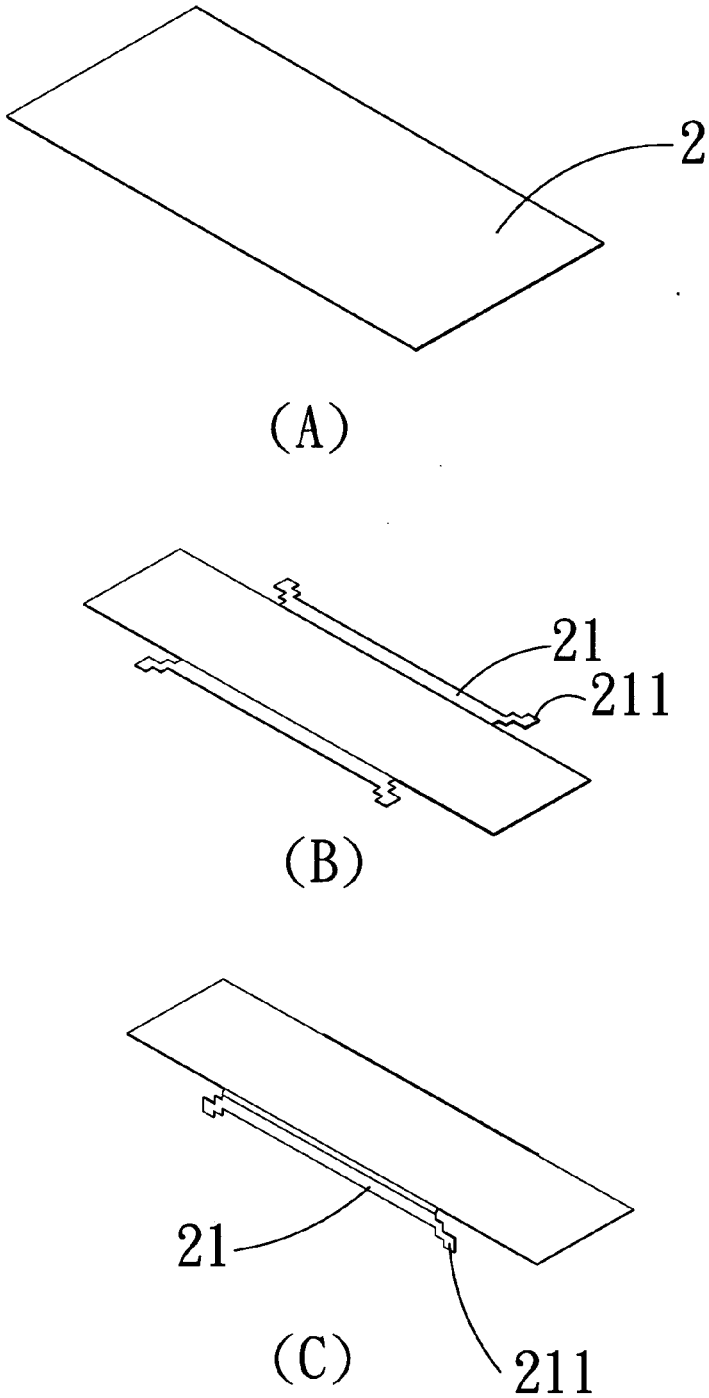
Fig. 1(PRIOR ART)
FIG. 1A shows a sheet raw material for manufacturing a heat radiating fin in a conventional method.
FIG. 1B shows the sheet raw material of FIG. 1A is primarily shaped by punching.
FIG. 1C shows the primarily shaped sheet material of FIG. 1B is bent at two opposite edges to complete a heat radiating fin.
FIG. 1D shows a plurality of the heat radiating fins of FIG. 1C are orderly stacked.
FIG. 1E shows the stacked heat radiating fins of FIG. 1D are sequentially connected together.
Figure 1:
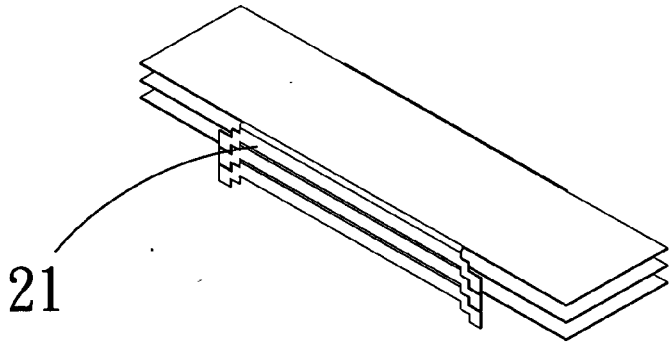
Fig. 1(PRIOR ART)
Figure 1:
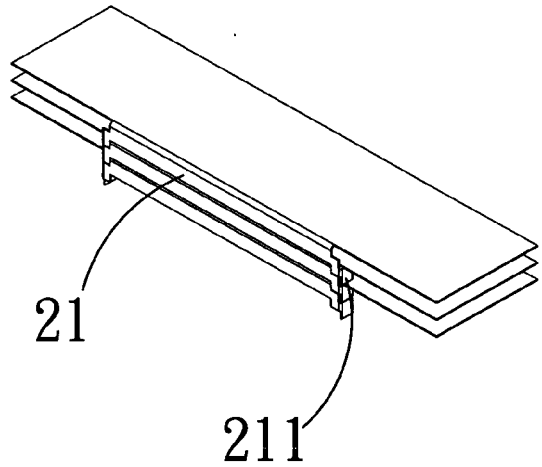
Fig. 1(PRIOR ART)
Figure 2:
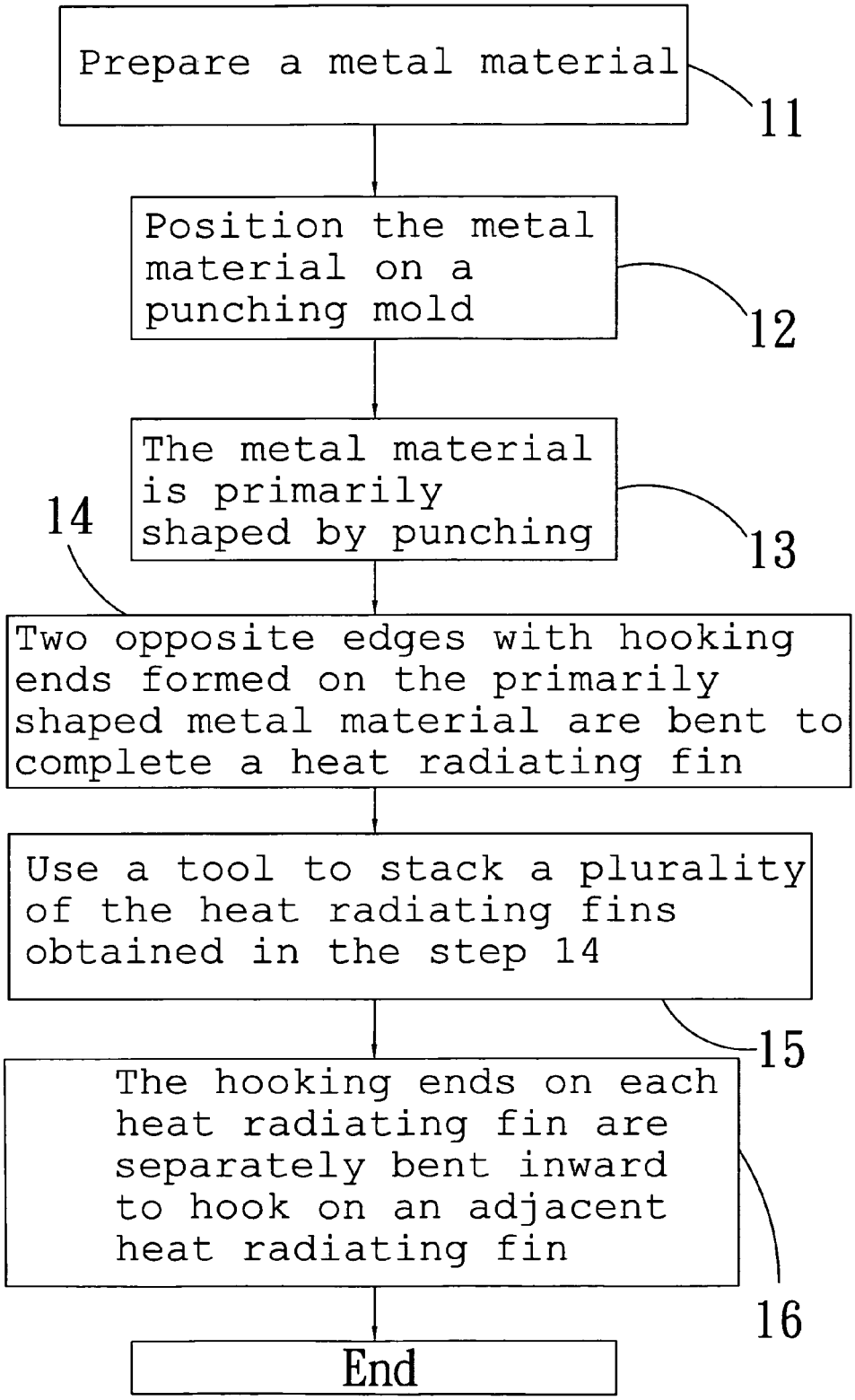
Fig. 2(PRIOR ART)
FIG. 2 is a flowchart showing the steps included in the conventional method of manufacturing heat radiating fins shown in FIGS. 1A to 1E.
Figure 3:
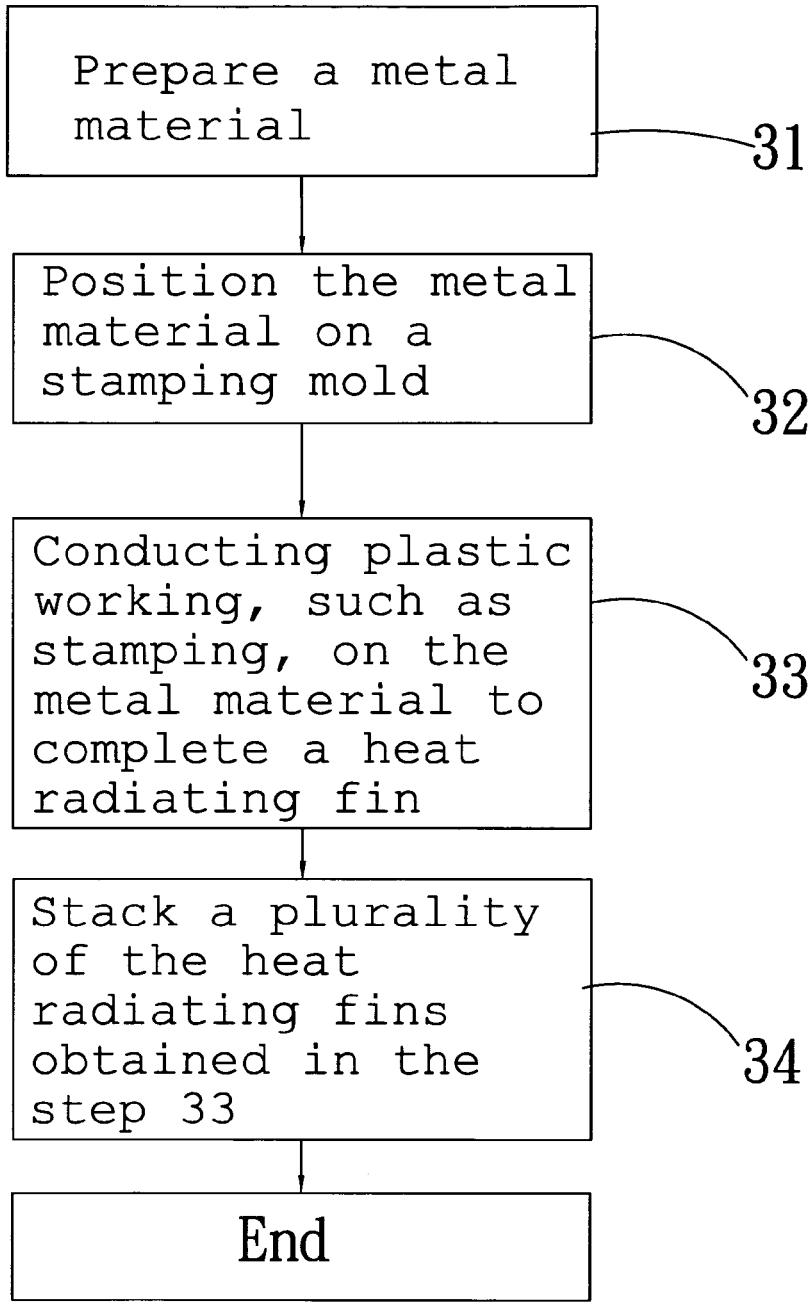
FIG. 3 is a flowchart showing the steps included in a method of manufacturing heat radiating fin according to a preferred embodiment of the present invention.

FIG. 3 is a flowchart showing the steps included in a method of manufacturing heat radiating fin according to a preferred embodiment of the present invention. Generally speaking, the present invention employs the technique of plastic working to apply an external force against a sheet metal material, so that the sheet metal material generates plastic deformation to form at least one recessed portion on a front side thereof. Meanwhile, a protruded portion is correspondingly formed on a rear side of the sheet metal material behind the recessed portion. Particularly, in the present invention, the recessed portion and accordingly, the protruded portion are formed on the sheet metal material preferably by stamping.

Figure 4:
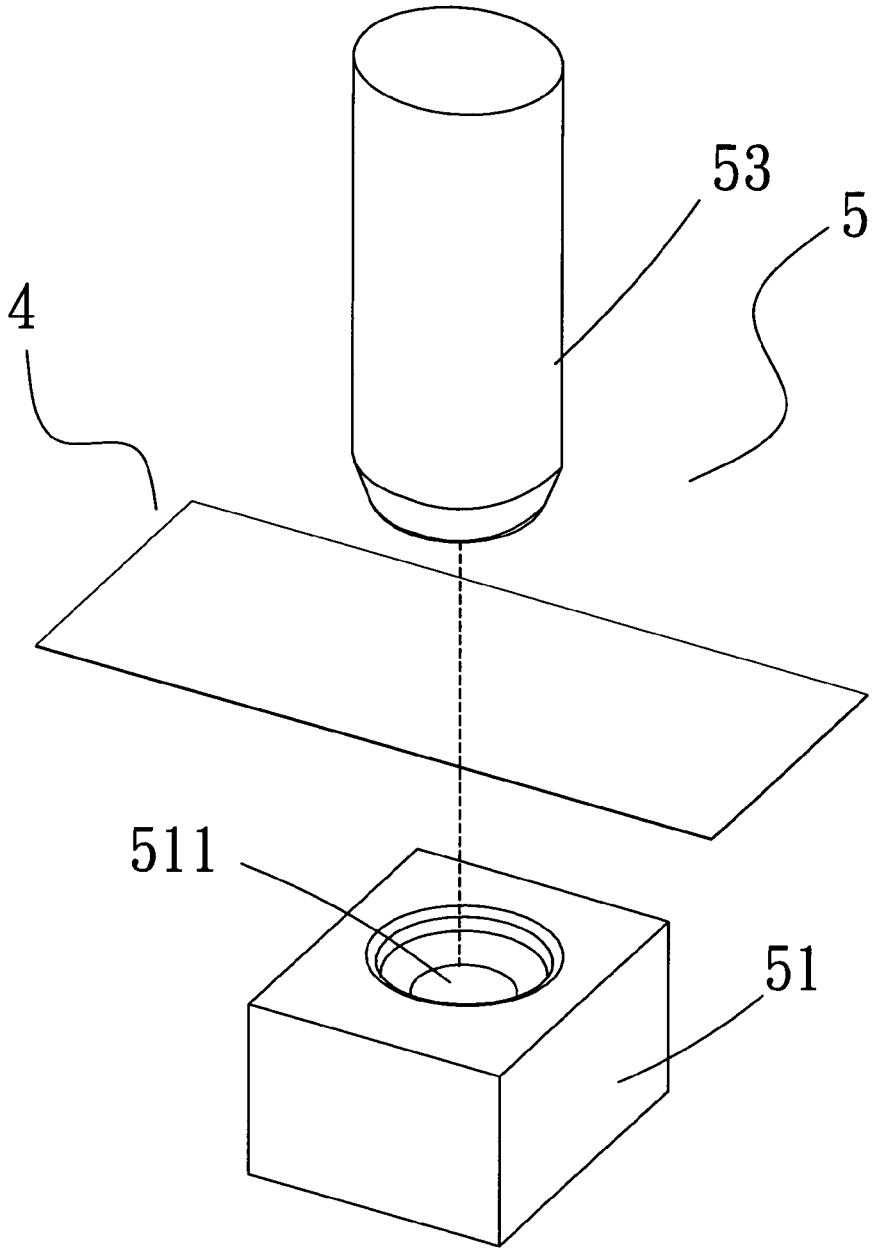
FIG. 4 shows a set of stamping tools used in the method of the present invention to stamp a sheet material in a first manner.

Please refer to FIG. 3 along with FIGS. 4 to 9. In a first step (31) of the method of the present invention for manufacturing a heat radiating fin 4, a sheet metal material as shown in FIG. 4 is prepared. The sheet metal material serves as a raw material for manufacturing the heat radiating fin 4, and may be aluminum, copper, or any other heat-conducting metal materials.

Figure 5:
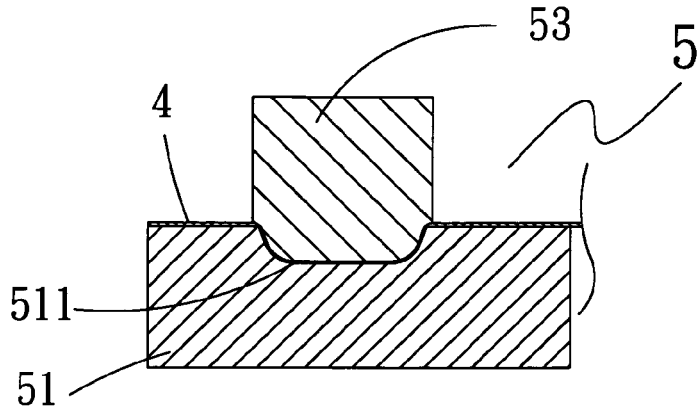
FIG. 5 is a fragmentary sectional view showing the manufacturing of a heat radiating fin using the set of stamping tools of FIG. 4.

In a second step (32), the sheet metal material is positioned between a female stamping mold 51 and a stamping hammer 53 of a set of stamping tools 5, as shown in FIGS. 4 and 5. The female stamping mold 51 is provided on a top with a mold cavity 511.

Figure 6:
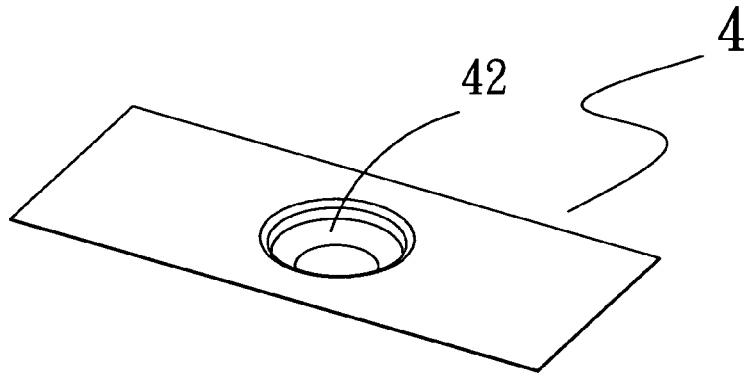
FIG. 6 is a front perspective view of the heat radiating fin manufactured in the method of the present invention using the stamping tools of FIG. 4, on which a recessed portion is formed.
Figure 7:
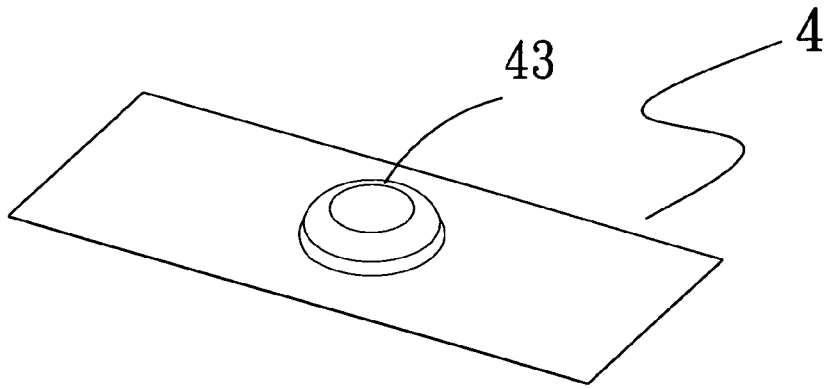
FIG. 7 is a rear perspective view of FIG. 6, showing a protruded portion is correspondingly formed behind the recessed portion.

In a third step (33), the sheet metal material is stamped, which is one type of plastic working. The sheet metal material is subjected to pressure applied by the stamping hammer 53 against it and generates plastic deformation to locally sink into the mold cavity 511 on the female stamping mold 51. When the stamping hammer 53 completes one stroke thereof, a recessed portion 42 having a configuration the same as that of the mold cavity 511 is formed on a front side of the sheet metal material as a result of plastic deformation, and a protruded portion 43 is correspondingly formed on a rear side of the sheet metal material behind the recessed portion 42 to complete the stamping and form a heat radiating fin 4, as shown in FIGS. 5, 6, and 7.

Figure 8:
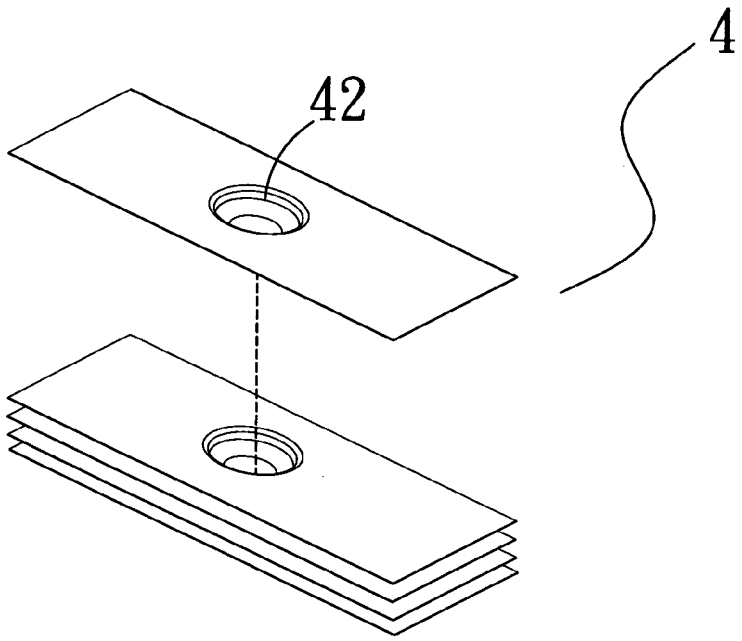
FIG. 8 shows a plurality of the heat radiating fins of FIGS. 6 and 7 are stacked.
Figure 9:
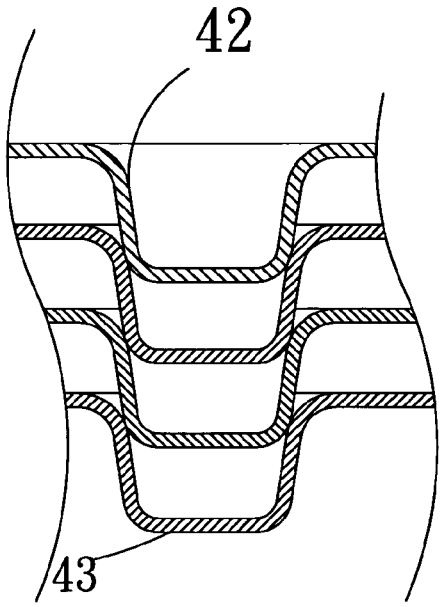
FIG. 9 is a fragmentary sectional view showing the stacked heat radiating fins of FIG. 8.

In a fourth step (34), a plurality of heat radiating fins 4 is stacked to form a heat sink, as shown in FIGS. 8 and 9. At this point, the protruded portion 43 of a second heat radiating fin 4 is partially extended into the recessed portion 42 of a first heat radiating fin 4 located before or below the second heat radiating fin 4, so that the first and the second heat radiating fin 4 are associated with each other.

The recessed portions 42 and the protruded portions 43 formed on the heat radiating fins 4 manufactured in the method of the present invention allow the heat radiating fins 4 to be easily assembled together. Moreover, since the recessed portion 42 is formed on the heat radiating fin 4 through stamping, which is one type of plastic working, the protruded portion 43 is integrally formed on the heat radiating fin 4 without any seam or separately formed bent edge to thereby have enhanced structural strength. As a result, the protruded portion 43 is not easily deformed under an external force when the heat radiating fin 4 is dismounted from the heat sink, and may still fitly and tightly contact with the recessed portion 42 on another heat radiating fin 4 without the risk of separating therefrom when the dismounted heat radiating fin 4 is remounted to the heat sink. Another advantage of the present invention is that the recessed and the protruded portion 42, 43 on the heat radiating fin 4 have simple structure, so that the molding tools 5 for forming them may have simple structure to reduce mold cost. The mold tools 5 with relatively simple structure are not subject to damage easily and may therefore have prolonged usable life.

Figure 10:
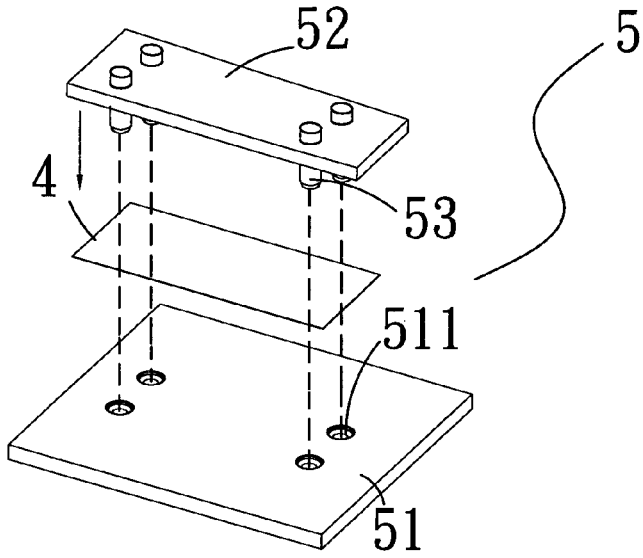
FIGS. 10 and 11 are perspective views showing another set of stamping tools used in the method of the present invention to stamp the sheet material in another manner.
Figure 11:
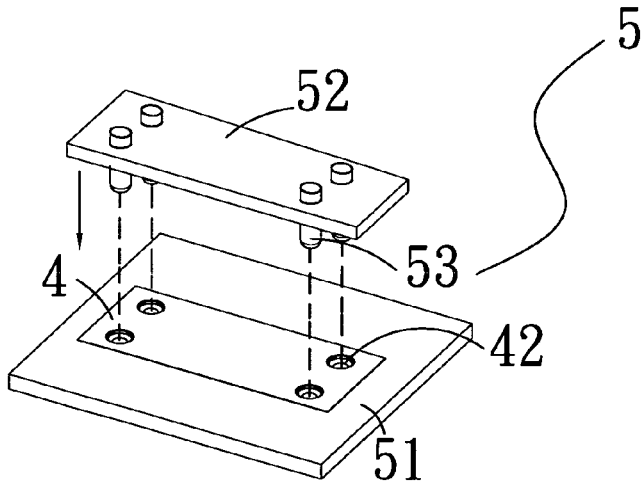
Figure 12:
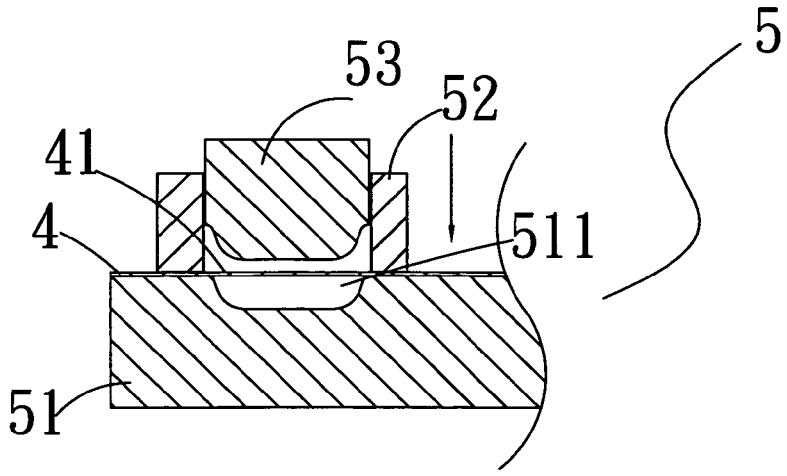
FIGS. 12 and 13 are fragmentary sectional views showing the manufacturing of a heat radiating fin using the stamping tools in FIGS. 10 and 11.
Figure 13:
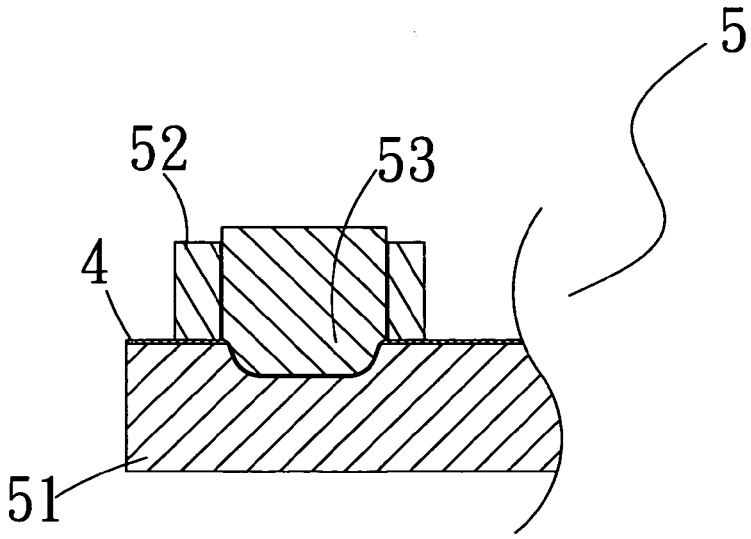
Figure 14:
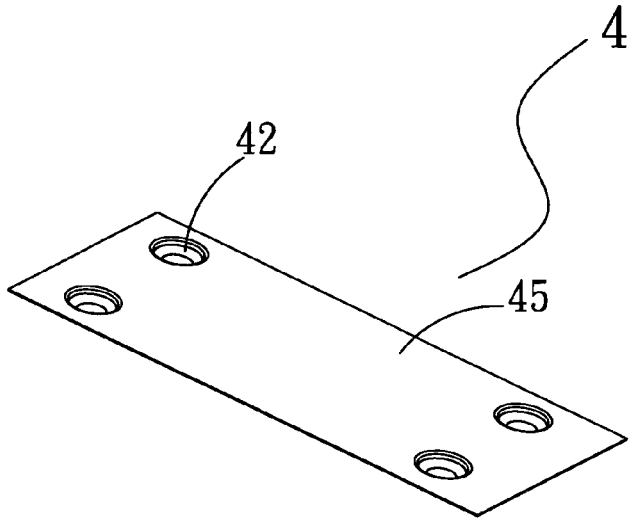
FIG. 14 is a front perspective view of the heat radiating fin manufactured in the method of the present invention using the stamping tools of FIGS. 10 and 11, on which a plurality of recessed portions is formed.
Figure 15:
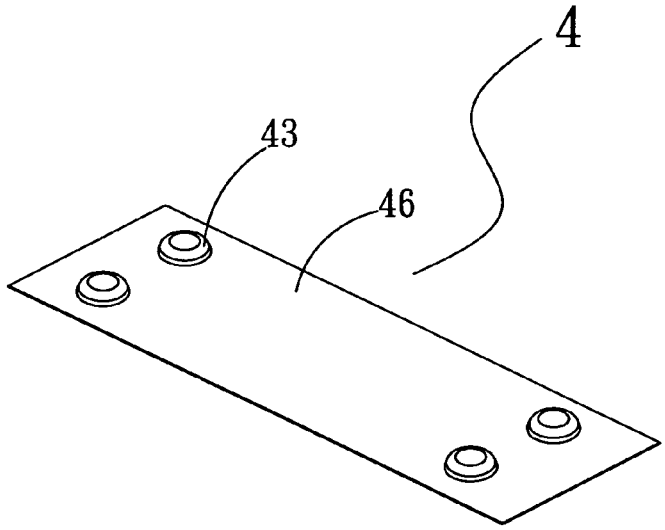
FIG. 15 is a rear perspective view of FIG. 14 showing a plurality of protruded portions is correspondingly formed behind the recessed portions.
Figure 16:
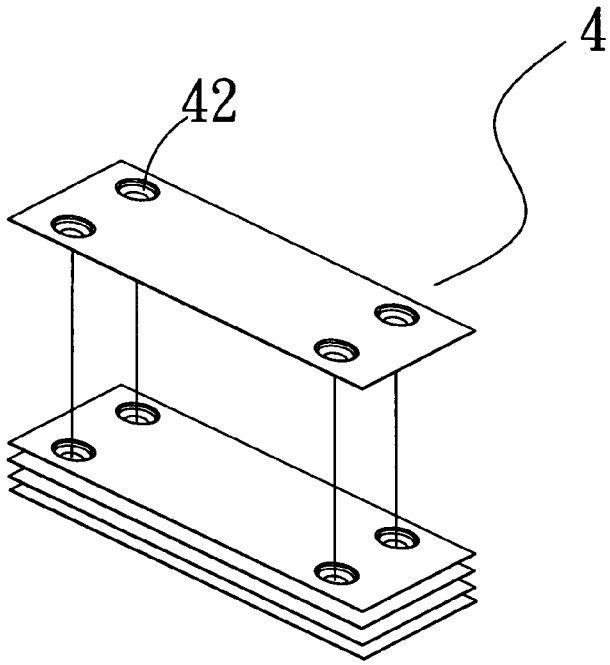
FIG. 16 shows a plurality of the heat radiating fins of FIGS. 14 and 15 are stacked.
Figure 17:
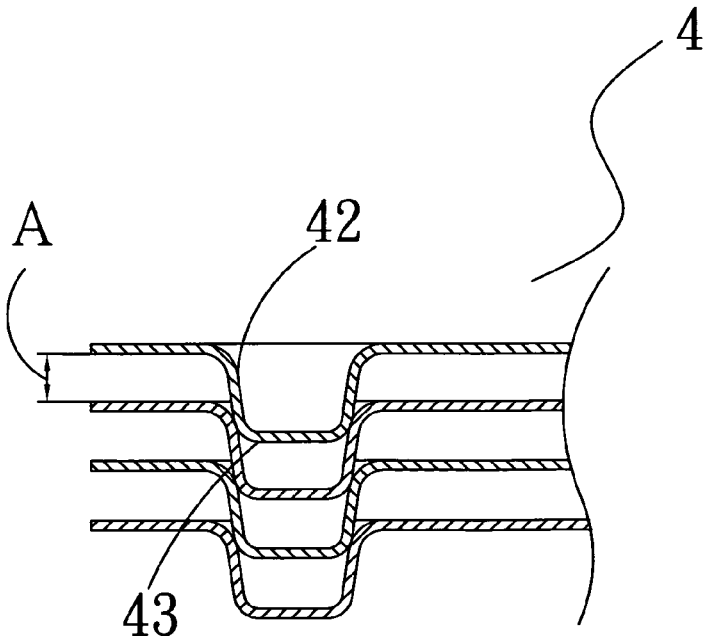
FIG. 17 is a fragmentary sectional view of the stacked second heat radiating fins of FIG. 16.

FIGS. 10 and 11 show another manner of stamping the sheet metal material in the same method of the present invention. In this case, the set of molding tools 5 include a female stamping mold 51, a male stamping mold 52, and a plurality of stamping hammers 53. The female stamping mold 52 has a plurality of mold cavities 511 formed thereon. Please refer to FIGS. 12 and 13. The sheet metal material is positioned on the female stamping mold 51 and is held thereto by the male stamping mold 52. The stamping hammers 53 are set in the male stamping mold 52, and caused to apply pressure against the sheet metal material. Areas on the sheet metal material subjected to the pressure from the stamping hammers 53 generate plastic deformation to locally sink into the mold cavities 511. When the stamping hammers 53 complete one stroke thereof, a plurality of recessed portions 42 having a configuration the same as that of the mold cavities 511 is formed on a front side 45 of the sheet metal material as a result of plastic deformation, and a plurality of protruded portions 43 is correspondingly formed on a rear side 46 of the sheet metal material behind the recessed portions 42 to complete the stamping and form a heat radiating fin 4, as shown in FIGS. 14 and 15. As can be seen from FIGS. 16 and 17, a plurality of heat radiating fins 4 manufactured in this manner is stacked to form a heat sink. At this point, the protruded portions 43 of a second heat radiating fin 4 are partially extended into the recessed portions 42 of a first heat radiating fin 4 located before or below the second heat radiating fin 4, so that the first and the second heat radiating fin 4 are associated with each other with a fixed spacing A maintained therebetween.

Figure 18:
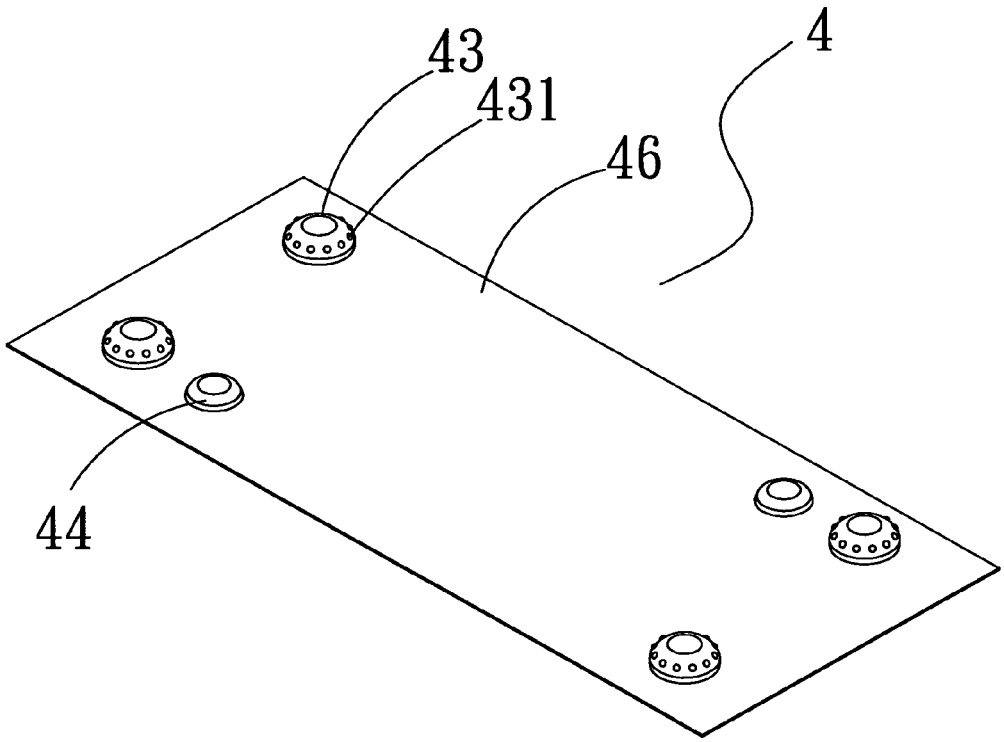
FIG. 18 shows a heat radiating fin manufacturing in the method of the present invention with at least one spacer protrusion formed thereon and a plurality of spaced dots formed around the protruded portions.
Figure 19:
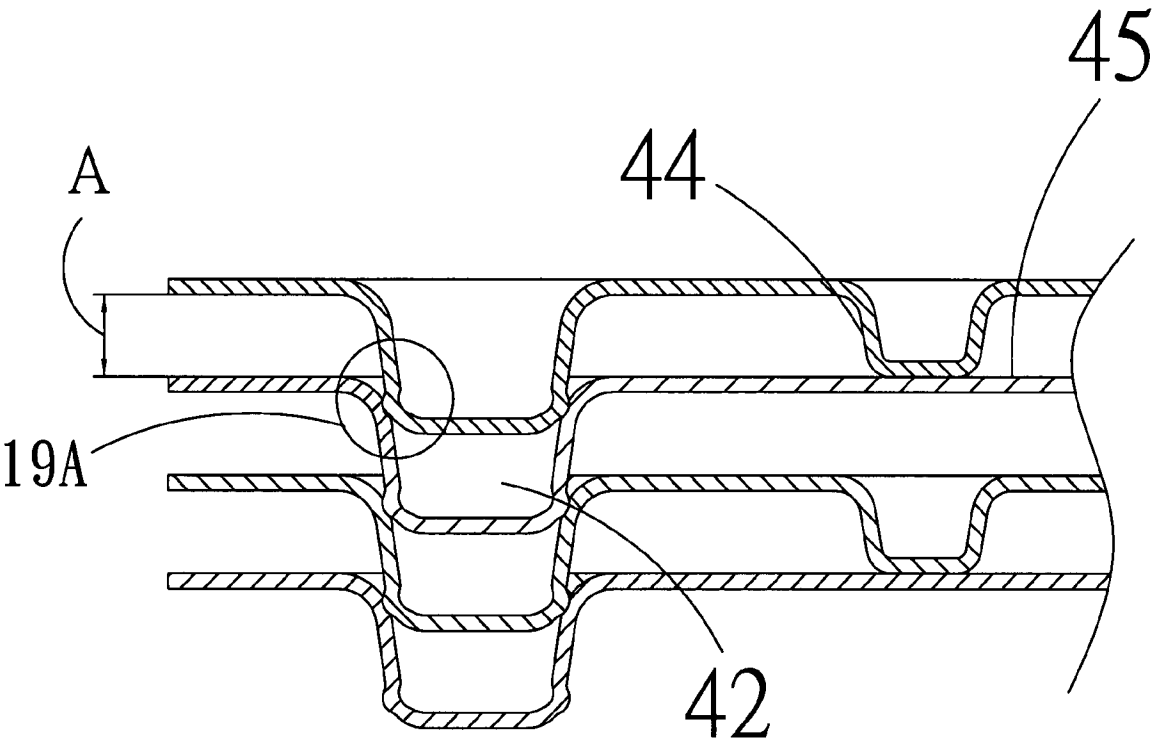
FIG. 19 is a fragmentary sectional view showing a plurality of the heat radiating fins of FIG. 18 is stacked.

The method of manufacturing heat radiating fin according to the present invention may further include a step of forming at least one spacer protrusion 44 on the rear side 46 of the sheet metal material, as shown in FIG. 18. The spacer protrusion 44 is also formed by stamping a predetermined area on the front side 45 of the sheet metal material, so that the area subjected to an external force generates plastic deformation and locally sinks to form a recess on the front side of the sheet metal material. As a result, a protruded area is correspondingly formed on the rear side 46 of the sheet metal material behind the recess to form the spacer protrusion 44. When a plurality of the heat radiating fins 4 manufactured in the method of the present invention is stacked, the spacer protrusions 44 on a second heat radiating fin 4 is in contact with the front side 45 of a first heat radiating fin 4 located before or below the second heat radiating fin 4, so as to maintain a fixed spacing A between the first and the second heat radiating fin 4, preventing the protruded portions 43 on the second heat radiating fin 4 from excessively extending into the recessed portions 42 on the first heat radiating fin 4, as shown in FIG. 19.

Figure 19A:
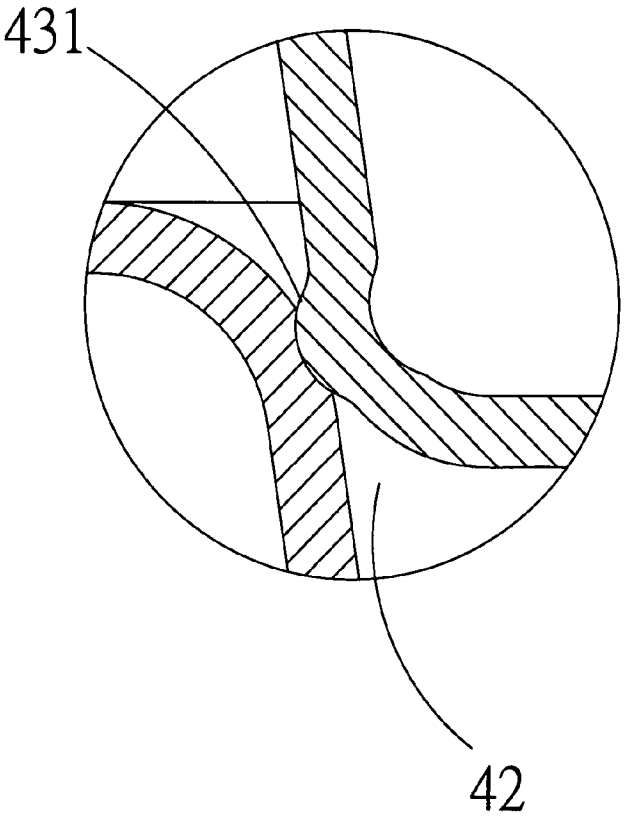
FIG. 19A is an enlarged view of the circled area in FIG. 19.

The method of manufacturing heat radiating fin according to the present invention may further include a step of forming a plurality of dots 431 around an outer surface of each of the protruded portions 43 using stamping tools, as shown in FIG. 18. When a plurality of heat radiating fins 4 manufactured in this manner is stacked with the protruded portions 43 of a second heat radiating fin 4 partially extended into the recessed portions 42 of a first heat radiating fin 4 located before or below the second heat radiating fin 4, the dots 431 on the outer surface of the protruded portions 43 are in contact with an inner rim of the recessed portions 42, as shown in FIG. 19A, enabling the protruded portions 43 to more tightly contact with the recessed portions 42 without being excessively extended thereinto, so that any two stacked heat radiating fins 4 always have a fixed spacing A maintained therebetween.

Figure 20:
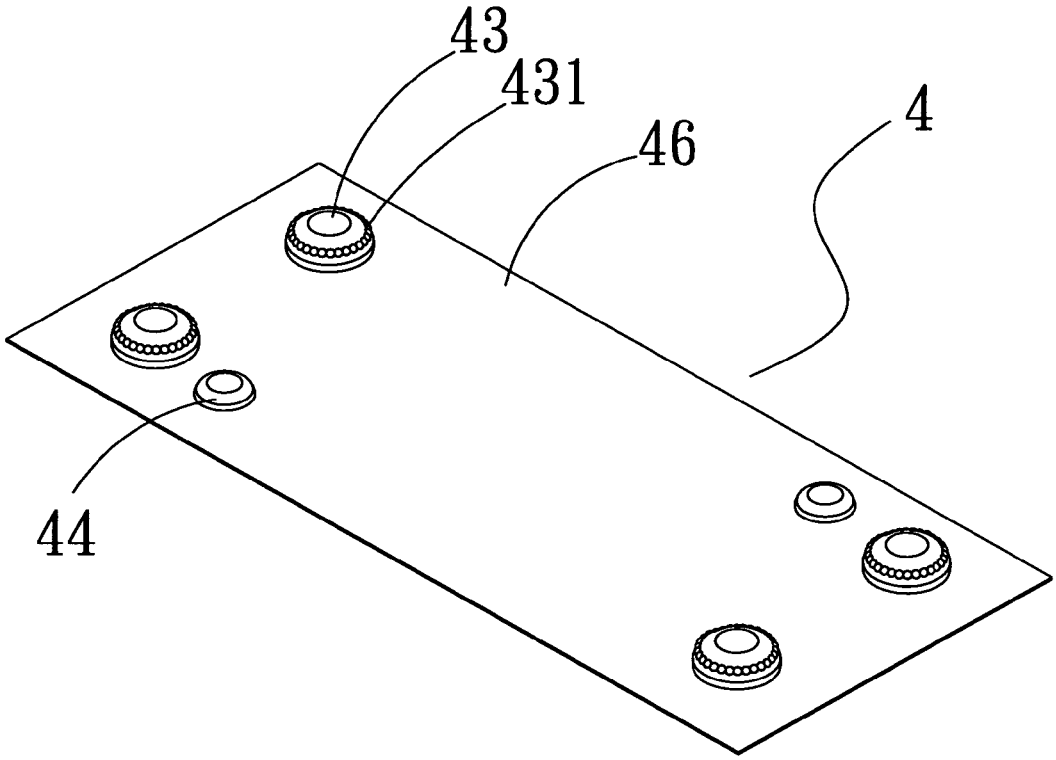
FIG. 20 shows a heat radiating fin manufacturing in the method of the present invention with a plurality of dots continuously formed around the protruded portions.
Figure 21:
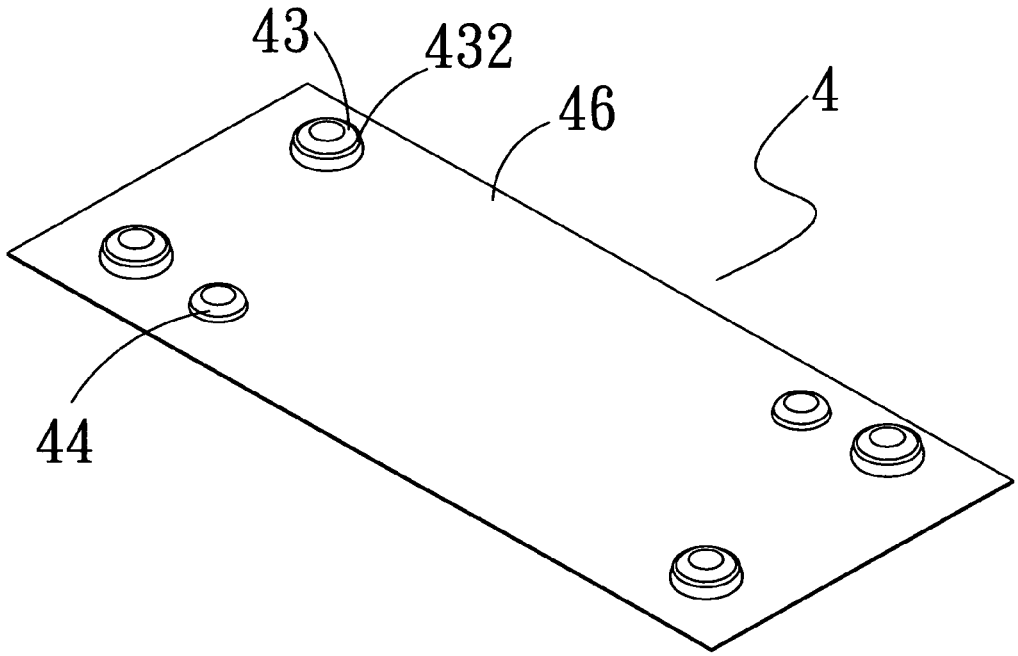
FIG. 21 shows a heat radiating fin manufacturing in the method of the present invention with an annular rib formed around the protruded portions.
Figure 22:
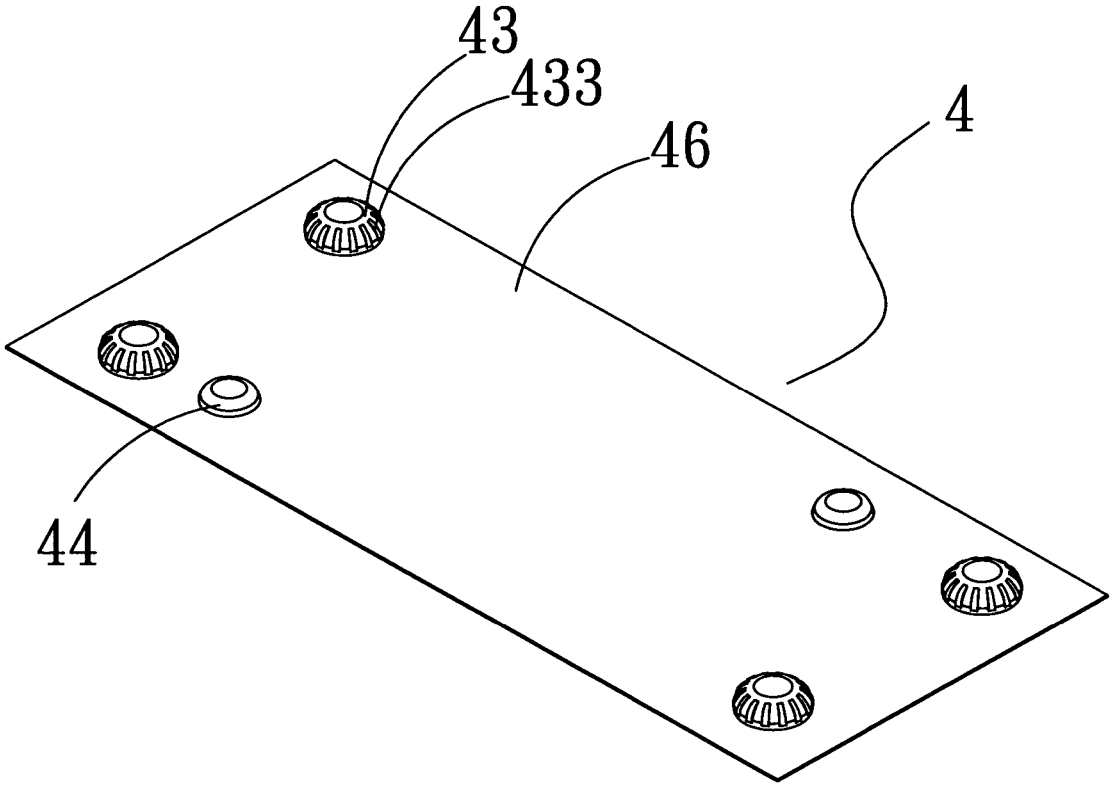
FIG. 22 shows a heat radiating fin manufacturing in the method of the present invention with a plurality of ribs spaced along the protruded portions.
Figure 23:
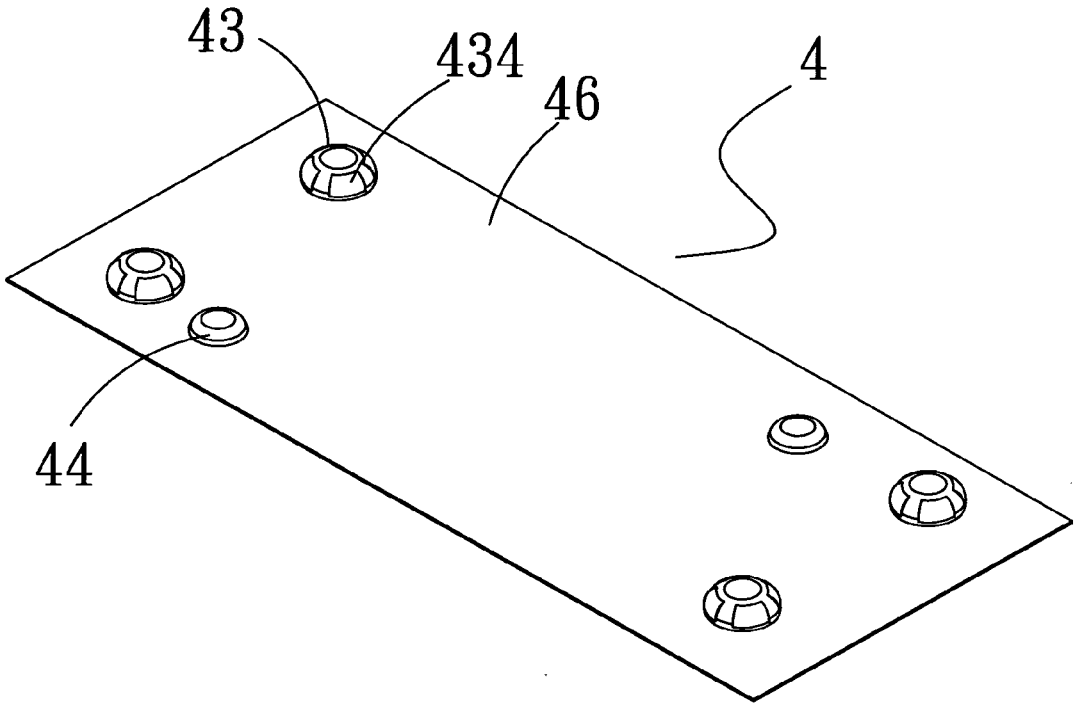
FIG. 23 shows a heat radiating fin manufacturing in the method of the present invention with a plurality of raised areas spaced along the protruded portions.

The dots 431 may be equally spaced from one another as shown in FIG. 18, or continuously arranged as shown in FIG. 20. In other alternative embodiments, the dots 431 may be replaced by an annular rib 432 formed around the outer surface of each protruded portion 43 as shown in FIG. 21, or a plurality of ribs 433 equally spaced along the outer surface of each protruded portion 43 as shown in FIG. 22, or a plurality of raised areas 434 equally spaced along the outer surface of each protruded portion 43 as shown in FIG. 23.

Figure 24:
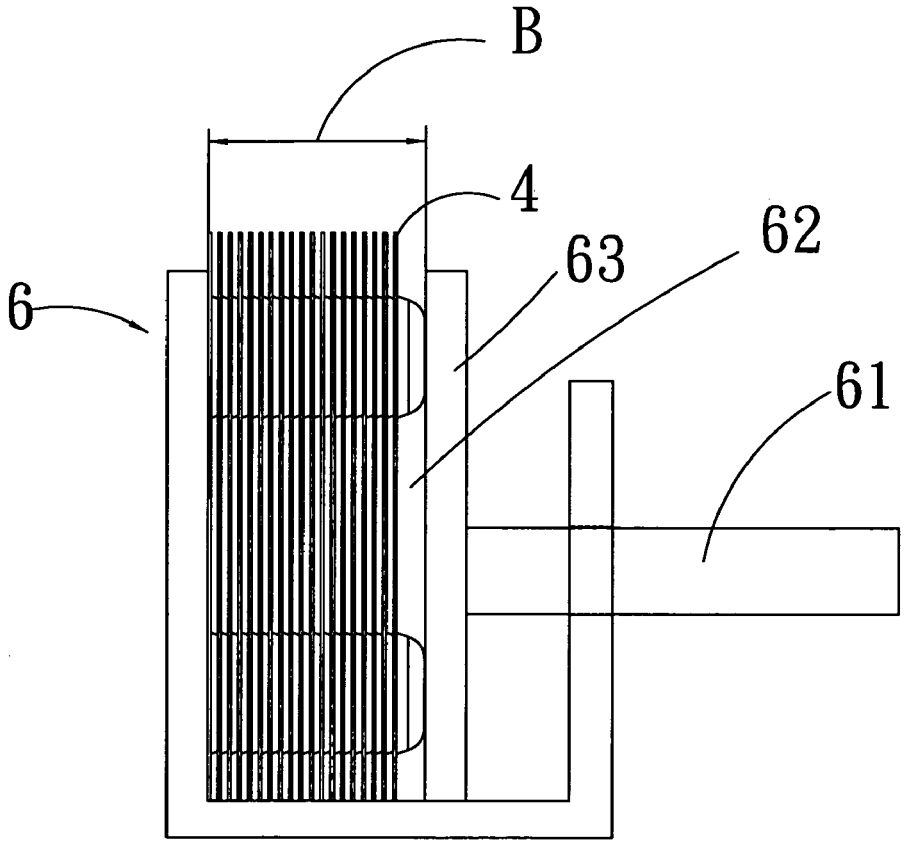
FIG. 24 shows an adjusting tool used in the method of the present invention for controlling an overall height of a stack of heat radiating fins manufactured in the method of the present invention.

FIG. 24 shows an adjusting tool 6 used to control an overall height B of a stack of heat radiating fins 4 manufactured in the method of the present invention. The adjusting tool 6 defines a receiving space 62, in which a plurality of stacked heat radiating fins 4 is positioned, and includes a movable push bar 61 having a push plate 63 fixedly connected to a front end thereof. When it is desired to decrease the overall height B of the stacked heat radiating fins 4, the push bar 61 is moved toward the stacked heat radiating fins 4 in the receiving space 62, so that the push plate 63 is in contact with and presses against the stacked heat radiating fins 4 until a desired overall height B is reached.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A method of manufacturing heat radiating fin, comprising:

providing a sheet material to serve as a raw material for manufacturing said heat radiating fin;

conducting plastic working on the sheet material for the sheet material to generate plastic deformation, so that a plurality of recessed portions is formed on a front side of the sheet material, and a plurality of protruded portions is correspondingly formed on a rear side of the sheet material behind the recessed portions to complete a heat radiating fin;

stacking a plurality of said heat radiating fins with the protruded portions on a second heat radiating fin partially extended into corresponding recessed portions on an adjacent first heat radiating fin located before or below the second heat radiating fin; and forming a plurality of dots around an outer surface of each of the protruded portions by way of plastic working, such that the dots on the protruded portions of the second heat radiating fin are in contact with inner rims of the recessed portions on the adjacent first heat radiating fin to prevent the protruded portions from being excessively extended into the recessed portions.

2. The method of manufacturing heat radiating fin as claimed in claim 1, wherein the plastic working is stamping.

3. The method of manufacturing heat radiating fin as claimed in claim 1, wherein the dots are continuously arranged around the outer surface of the protruded portions.

4. The method of manufacturing heat radiating fin as claimed in claim 1, wherein the dots are equally spaced along the outer surface of the protruded portions.

5. The method of manufacturing heat radiating fin as claimed in claim 1, wherein the sheet material serving as the raw material for manufacturing the heat radiating fin is a heat conducting material.

6. The method of manufacturing heat radiating fin as claimed in claim 5, wherein the heat conducting material is a copper material.

7. The method of manufacturing heat radiating fin as claimed in claim 5, wherein the heat conducting material is an aluminum material.

8. A method of manufacturing heat radiating fin, comprising the following steps:

providing a sheet material to serve as a raw material for manufacturing said heat radiating fin;

conducting plastic working on the sheet material for the sheet material to generate plastic deformation, so that a plurality of recessed portions is formed on a front side of the sheet material, and a plurality of protruded portions is correspondingly formed on a rear side of the sheet material behind the recessed portions to complete a heat radiating fin;

stacking a plurality of said heat radiating fins with the protruded portions on a second heat radiating fin partially extended into corresponding recessed portions on an adjacent first heat radiating fin located before or below the second heat radiating fin; and forming an annular rib around an outer surface of each of the protruded portions by way of plastic working, such that the annular ribs on the protruded portions of the second heat radiating fin are in contact with inner rims of the recessed portions on the first heat radiating fin to prevent the protruded portions from being excessively extended into the recessed portions.

9. A method of manufacturing heat radiating fin, comprising the following steps:

providing a sheet material to serve as a raw material for manufacturing said heat radiating fin;

conducting plastic working on the sheet material for the sheet material to generate plastic deformation, so that a plurality of recessed portions is formed on a front side of the sheet material, and a plurality of protruded portions is correspondingly formed on a rear side of the sheet material behind the recessed portions to complete a heat radiating fin;

stacking a plurality of said heat radiating fins with the protruded portions on a second heat radiating fin partially extended into corresponding recessed portions on an adjacent first heat radiating fin located before or below the second heat radiating fin; and forming a plurality of ribs equally spaced along an outer surface of each of the protruded portions by way of plastic working, such that the spaced ribs on the protruded portions of the second heat radiating fin are in contact with inner rims of the recessed portions on the first heat radiating fin to prevent the protruded portions from being excessively extended into the recessed portions.

10. A method of manufacturing heat radiating fin, comprising the following steps:

providing a sheet material to serve as a raw material for manufacturing said heat radiating fin;

conducting plastic working on the sheet material for the sheet material to generate plastic deformation, so that a plurality of recessed portions is formed on a front side of the sheet material, and a plurality of protruded portions is correspondingly formed on a rear side of the sheet material behind the recessed portions to complete a heat radiating fin;

stacking a plurality of said heat radiating fins with the protruded portions on a second heat radiating fin partially extended into corresponding recessed portions on an adjacent first heat radiating fin located before or below the second heat radiating fin; and forming a plurality of raised areas equally spaced along an outer surface of each of the protruded portions by way of plastic working, such that the raised areas on the protruded portions of the second heat radiating fin are in contact with inner rims of the recessed portions on the first heat radiating fin to prevent the protruded portions from being excessively extended into the recessed portions.

* * * * *